US005217360A

United States Patent [19]

Kawahara et al.

[11] Patent Number: 5,217,360

[45] Date of Patent: Jun. 8, 1993

[54] SCROLL COMPRESSOR WITH SWIRLING IMPELLER BIASED BY COOLED LUBRICANT

[75] Inventors: Sadao Kawahara, Otsu; Michio Yamamura, Kusatsu; Jiro Yuda, Ikoma; Yoshinori Kojima, Kusatsu; Shuichi Yamamoto, Otsu; Manabu Sakai, Toyonaka; Shigeru Muramatsu; Osamu Aiba, both of Kusatsu, all of Japan

[73] Assignee: Matsushita Electric Industrial Co., Ltd., Osaka, Japan

[21] Appl. No.: 720,456

[22] PCT Filed: Nov. 2, 1990

[86] PCT No.: PCT/JP90/01414

§ 371 Date: Sep. 3, 1991

§ 102(e) Date: Sep. 3, 1991

[87] PCT Pub. No.: WO91/06766

PCT Pub. Date: May 16, 1991

[30] Foreign Application Priority Data

Nov. 2, 1989 [JP] Japan ..... 1-287012

[51] Int. Cl.[5] ..... F04C 18/04; F04C 29/02; F04C 29/04

[52] U.S. Cl. ..... 418/55.5; 418/55.6; 418/85

[58] Field of Search ..... 418/55.5, 55.6, 85, 418/57

[56] References Cited

U.S. PATENT DOCUMENTS 4,889,471 12/1989 Izunaga et al. ..... 418/55.6

FOREIGN PATENT DOCUMENTS 58-15787 1/1983 Japan .
59-93987 5/1984 Japan .
59-110893 6/1984 Japan .
61-112794 5/1986 Japan ..... 418/85
63-131888 6/1988 Japan ..... 418/55.6
1-177482 7/1989 Japan .

*Primary Examiner*—John J. Vrablik
*Attorney, Agent, or Firm*—Stevens, Davis, Miller & Mosher

[57] ABSTRACT

A swirling spiral impeller portion 13 is structured such that a pressure between the suction and discharge pressures acts on a part of the rear surface thereof. The compressor includes a means for adjusting and cooling the intermediate pressure which acts on a part of the swirling spiral impeller portion 13 by means of the lubricant oil stored in a lubricant oil reservoir 26 to which the discharge pressure in the sealed container acts. The lubricant oil supplied to the compression portion is provided under any pressure condition, and is always supplied stably. As the lubricant oil is cooled, it does not reduce the efficiency greatly.

1 Claim, 2 Drawing Sheets

SCROLL COMPRESSOR WITH SWIRLING IMPELLER BIASED BY COOLED LUBRICANT

TECHNICAL FIELD

The present invention relates to a scroll type electric motor driven compressor.

BACKGROUND ART

FIG. 1 is a vertical cross-sectional view of a conventional scroll compressor disclosed in Japanese Patent Unexamined Publication No. 59-110893. A sealed container 30 houses a compression mechanism portion 31 at its upper portion and a motor 32 at its lower portion. The compression mechanism portion 31 includes a swirling spiral impeller portion 33 which performs swirling motion, and a fixed spiral impeller portion 34 meshed with the swirling spiral impeller portion 33 for compressing coolant gas. The fixed spiral impeller portion 34 is fixed to a bearing frame 35. A lower end of a crank shaft 36 which is formed integrally with a rotary shaft of the motor 32 is dipped into an oil stored in an oil reservoir 37 formed at the lower portion of the sealed container 30. An oil hole 38 is formed in the crank shaft 36. The lower end of the oil hole 38 is opened at the axis of the crank shaft 36, and the upper end thereof is opened at a position eccentric with respect to the axis of the rotary shaft. A communication hole 39 is provided in the swirling spiral impeller portion 33 at a position where the intermediate pressure between the suction and discharge pressures is obtained, and an intermediate pressure chamber 40 for the intermediate pressure is provided. A balance weight 41 is fixed to the crank shaft 36 within the intermediate pressure chamber 40. The swirling spiral impeller portion 33 is pressed against and thereby closely fitted to the fixed spiral impeller portion 34 due to the difference between the intermediate pressure and the internal pressure of the compressor. As the discharge pressure in the sealed container is higher than the internal pressure in the intermediate pressure chamber 40, the lubricant oil is pushed up through the oil hole 38 in the crank shaft 36 also due to the pressure difference and supplied to a sliding portion of the compressor. Thereafter, the lubricant oil is discharged into the intermediate pressure chamber 40. An oil reservoir portion 42 is provided in the bearing portion 35 which forms a part of the intermediate pressure chamber 40 so as to allow the lubricant oil discharged into the intermediate pressure chamber 40 to be readily stored temporarily. The oil reservoir portion 42 has an oil hole 43. The lubricant oil is led to the outside of the compressor from the oil hole 43 and through an oil pipe 44, cooled by cooling fins 45 and then led to an oil hole 46 provided in the fixed spiral impeller portion 34. The oil hole 46 provided in the fixed spiral impeller portion 34 is opened into a portion whose pressure is lower than that in the intermediate pressure chamber 40. The lubricant oil discharged into the intermediate pressure chamber 40 is discharged into the portion whose pressure is lower than that of the intermediate pressure chamber 40 from the oil hole 46 due to the pressure difference.

However, in the compressor arranged in the manner described above, the lubricant oil stored in the lubricant oil reservoir is led from the lower portion of the sealed container due to the pressure difference. An air conditioner is under various types of pressure conditions during the actual operation, and the amount of lubricant oil stored in the lubricant oil reservoir is thus not stable. Consequently, the amount of lubricant oil supplied to the compressing portion is not stable, and the performance of the compressor is thus varied greatly.

DISCLOSURE OF INVENTION

To overcome the aforementioned problem, the present invention provides a compressor which includes a sealed container, a motor disposed in the sealed container, and a compression mechanism driven by the motor and disposed in the sealed container. The compression mechanism includes a fixed spiral impeller portion having fixed spiral blades fixed to or formed integrally with a fixed impeller frame, a swirling spiral impeller portion having swirling spiral blades meshed with the fixed spiral blades to form a plurality of compression spaces, the swirling spiral blades being fixed to the surface of or formed integrally with a swirling end plate, a turn restricting portion for restricting turn of the swirling spiral impeller portion, a crank shaft for driving the swirling spiral impeller portion in an eccentric fashion, and a bearing portion for supporting a main shaft of the crank shaft. The swirling spiral impeller portion is structured such that a pressure between the suction and discharge pressures acts on a part of the rear surface thereof. The compressor includes a means for adjusting and cooling the intermediate pressure which acts on a part of the swirling spiral impeller portion by means of the lubricant oil stored in a lubricant oil reservoir to which the discharge pressure in the sealed container acts.

BEST MODE FOR CARRYING OUT THE INVENTION

Figure 1:
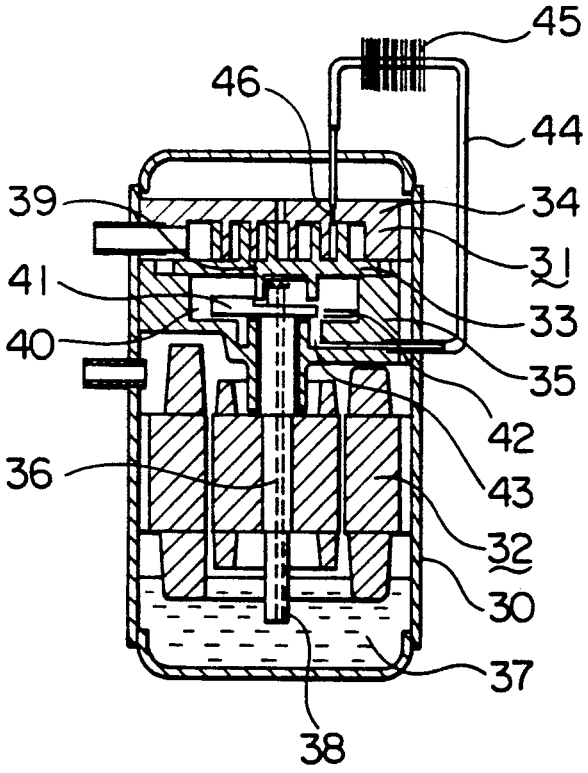
FIG. 1 PRIOR ART
FIG. 1 is a vertical cross-sectional view of a conventional scroll compressor.
Figure 2:
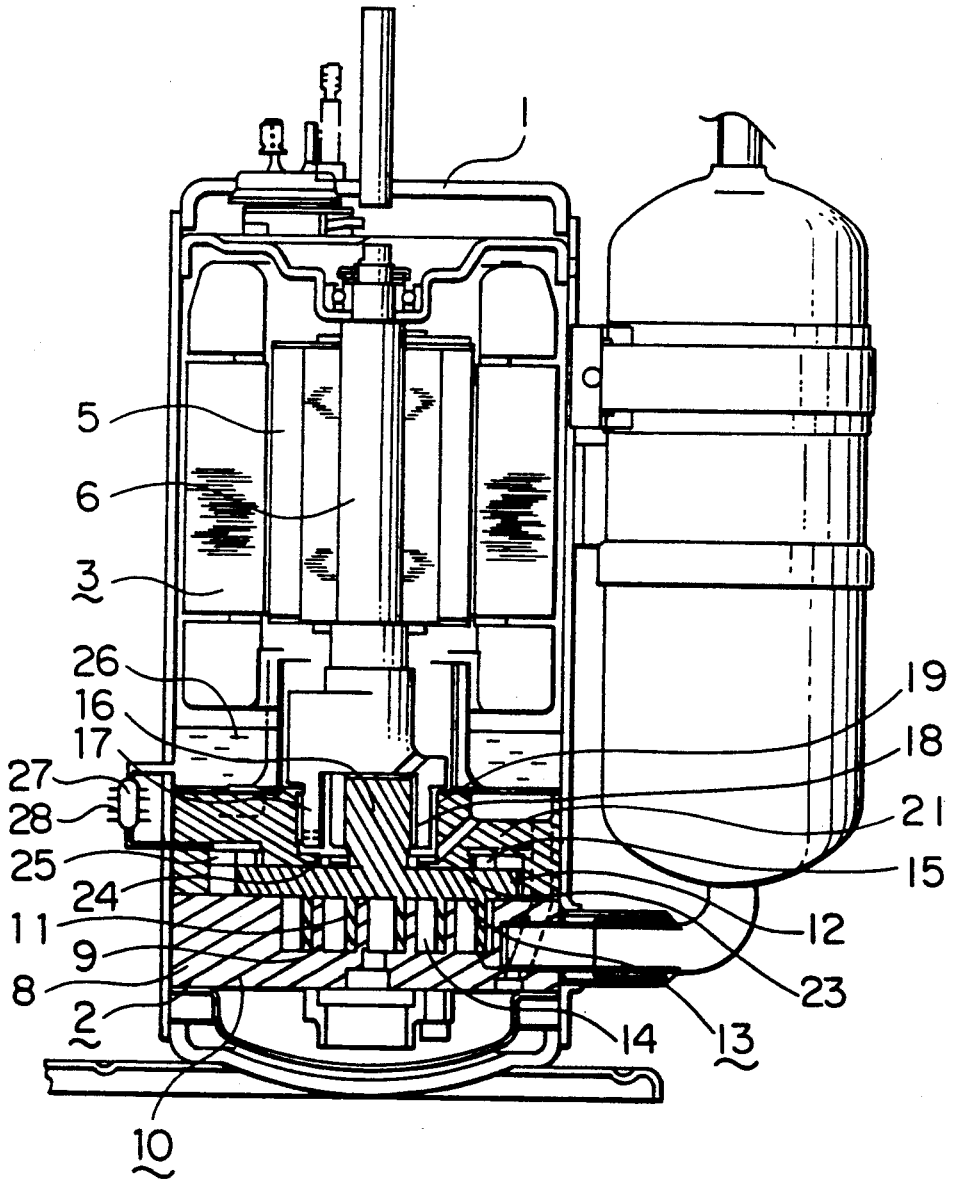
FIG. 2 is a vertical cross-sectional view of an embodiment of the scroll compressor according to the present invention.

FIG. 2 is a vertical cross-sectional view of an embodiment of a scroll compressor according to the present invention. A stator of a motor 3 for driving a compression mechanism 2 is fixed to the inner surface of a sealed container 1. A crank shaft 6 for driving the compression mechanism 2 is coupled to a rotor 5 of the motor 3. The compression mechanism 2 includes a fixed spiral impeller portion 10 having fixed spiral blades 9 formed integrally with a fixed frame 8, a swirling spiral impeller portion 13 having swirling spiral blades 11 meshed with the fixed spiral blades 9 to form a plurality of compression spaces 14, the swirling spiral blades 11 being formed on a swirling end plate 12, and a turn restricting portion 15 for restricting turn of the swirling spiral impeller portion and thereby making it only swirl. A swirl driving shaft 16 provided on the surface of the swirling end plate which is remote from the swirling spiral blades is fitted into an eccentric bearing 18 provided in a main shaft 17 formed at one end of the crank shaft 6, which is supported by a bearing portion 21 having a main shaft receiver 19 for supporting the main shaft 17. An axial direction control plate 23 for restricting the axial movement of the swirling spiral impeller portion 13 is disposed in such a manner that it is separated from the rear surface of the swirling end plate 12 by a small gap. Also, an annular back pressure partitioning ring 24 is disposed on the rear surface of the swirling end plate 12 in such a manner that it is slidable on the rear surface thereof. The back pressure partitioning ring 24 partitions the back surface of the swirling end plate 12 such that a discharge pressure acts on the central portion thereof while a back pressure lower than the discharge pressure acts on a back pressure chamber 25 provided on the periphery. A lubricant oil reservoir 26 is provided in space in the sealed container 1 between the compression mechanism 2 and the motor 3. The lubricant oil reservoir 26 substantially forms the lower surface of the sealed container 1 which stores the lubricant oil stably. The lubricant oil reservoir 26 and the back pressure chamber 25 communicate with each other through a restriction mechanism 27 which uses a thin pipe. Cooling fins 28 are provided halfway through the circuit which forms the restriction mechanism 27. The pressure in the back pressure chamber 25 can be adjusted to a given value by reducing the pressure of the high-temperature and high-pressure lubricant oil stored in the lubricant oil reservoir 26 by means of the restriction mechanism 27. The lubricant oil reservoir 26 substantially forms the lower portion of the sealed container 1, and the lubricant oil which lubricates the individual moving portions returns to this lubricant oil reservoir 26. Consequently, the amount of oil stored in the lubricant oil reservoir 26 is always stable, and the amount of oil supplied to adjust the pressure in the back pressure chamber 25 is therefore stable. Furthermore, the restriction mechanism 27 is provided outside of the sealed container, and the lubricant oil which flows through the restriction mechanism 27 is cooled by the cooling fins. Consequently, the high-temperature lubricant oil is not directly introduced into the back pressure chamber 25, and reduction in the efficiency due to the lubricant oil which flows into the compression mechanism 2 does not occur.

INDUSTRIAL APPLICABILITY

In the present invention, the intermediate pressure which acts on a part of the swirling spiral impeller portion is adjusted by the lubricant oil on which the discharge pressure i the sealed container acts and which is stored in the lubricant oil reservoir which substantially forms the lower portion of the sealed container. Consequently, the lubricant oil to be supplied to the compression portion is provided under any pressure condition and is always supplied stably. Also, cooling of the lubricant oil does not reduce the efficiency of the compressor greatly.

We claim:

1. A scroll compressor comprising a sealed container, a motor disposed in said sealed container, and a compression mechanism driven by said motor, said compression mechanism being disposed in said sealed container, said compression mechanism including a fixed spiral impeller portion having fixed spiral blades fixed to or formed integrally with a fixed impeller frame, a swirling spiral impeller portion having swirling spiral blades meshed with the fixed spiral blades to form a plurality of compression spaces, said swirling spiral blades being fixed to a surface of or formed on a swirling end plate, a turn restricting portion for restricting turn of the swirling spiral impeller portion, a crank shaft for driving said swirling spiral impeller portion in an eccentric fashion, a bearing portion for supporting a main shaft of said crank shaft, a lubricant oil reservoir provided in said sealed container and subjected to a discharge pressure of said compression mechanism, communication passage means for supplying lubricant oil from said lubricant oil reservoir to a part of a rear surface of said swirling spiral impeller portion, means provided on said communication passage means and having a restriction function and a cooling function for applying an intermediate pressure between a suction pressure and the discharge pressure to said part of the rear surface of said swirling spiral impeller portion, and means for supplying lubricant oil from said part of the rear surface of said swirling spiral impeller portion to said compression mechanism.

* * * * *